United States Patent [19]

Kondo et al.

[11] 4,277,665

[45] Jul. 7, 1981

[54] ILLUMINATED PUSH-BUTTON ELECTRICAL SWITCH

[75] Inventors: Shiro Kondo; Michitada Akazawa, both of Furukawa, Japan

[73] Assignee: Alps Electric Co., Ltd., Tokyo, Japan

[21] Appl. No.: 109,842

[22] Filed: Jan. 7, 1980

[30] Foreign Application Priority Data

Jan. 10, 1979 [JP] Japan ..... 54/2475[U]

[51] Int. Cl.[3] ..... H01H 9/00

[52] U.S. Cl. ..... 200/314; 200/311

[58] Field of Search ..... 200/310, 311, 314, 317, 200/340; 116/DIG. 28; 353/84; 350/315; 362/321; 35/9 H

[56] References Cited

U.S. PATENT DOCUMENTS

| | | | |
|---|---|---|---|
| 1,285,753 | 11/1918 | Lowenstein | 35/9 H |
| 3,215,036 | 11/1965 | Kirkconnell et al. | 353/84 |
| 3,287,827 | 11/1966 | Lippman | 350/315 |
| 3,601,566 | 8/1971 | Hansen | 200/314 |
| 3,715,548 | 2/1973 | Schadon | 200/311 |
| 3,780,248 | 12/1973 | Martin | 200/314 |
| 3,895,204 | 7/1975 | Lewis | 200/314 |
| 3,969,609 | 7/1976 | Wanner et al. | 200/314 |
| 4,031,849 | 6/1977 | Mehta | 200/309 |
| 4,129,766 | 12/1978 | Miyata et al. | 200/340 |
| 4,131,777 | 12/1978 | Bailey et al. | 200/311 |

*Primary Examiner*—John W. Shepperd

*Attorney, Agent, or Firm*—Guy W. Shoup; Gerard F. Dunne

[57] ABSTRACT

A push-button electrical switch is described having an illuminated window showing the status of the switch. The window includes the words "ON" and "OFF" in differing but complementary colors and two filter members also of differing but the same complementary colors are rotated selectively into the light path to the window in order to illuminate either the word "ON" or "OFF".

1 Claim, 5 Drawing Figures

ILLUMINATED PUSH-BUTTON ELECTRICAL SWITCH

BACKGROUND OF THE INVENTION

The present invention relates to illuminated push-button electrical switches.

Such switches, for example, have operating members which are formed from a molded plastic material, the end surface of which are tranparent for passing through light from a light source. Thus, in U.S. Pat. No. 3,780,248 or U.S. Pat. No. 3,895,204, a push-button electrical switch unit is described in which the end surface of the operating member is illuminated from the interior of the switch by means of lamp.

Such push-button switches, however, are difficult to distinguish the operative condition of the switch because they indicate donditions by means of different color beams.

It would be disirable to provide illuminated push-button electrical switch units which can indicate the operative condition of the switch by means of letterings illuminated by specific color.

SUMMARY OF THE INVENTION

It is therefore an object of the present invention is to provide a new and improved illuminated push-button electrical switch which can indicate the operating condition of the switch not only by letterings, but also by color.

Another object of the invention is to provide new and improved illuminated push-button electrical switch which can indicate two diffirent colored letters by means of a single light source, Other objects and advantages will appear from the following description in conjunction with the accompanying drawings.

DESCRIPTION OF THE PREFERRED EMBODIMENTS

Figures 1, 3:
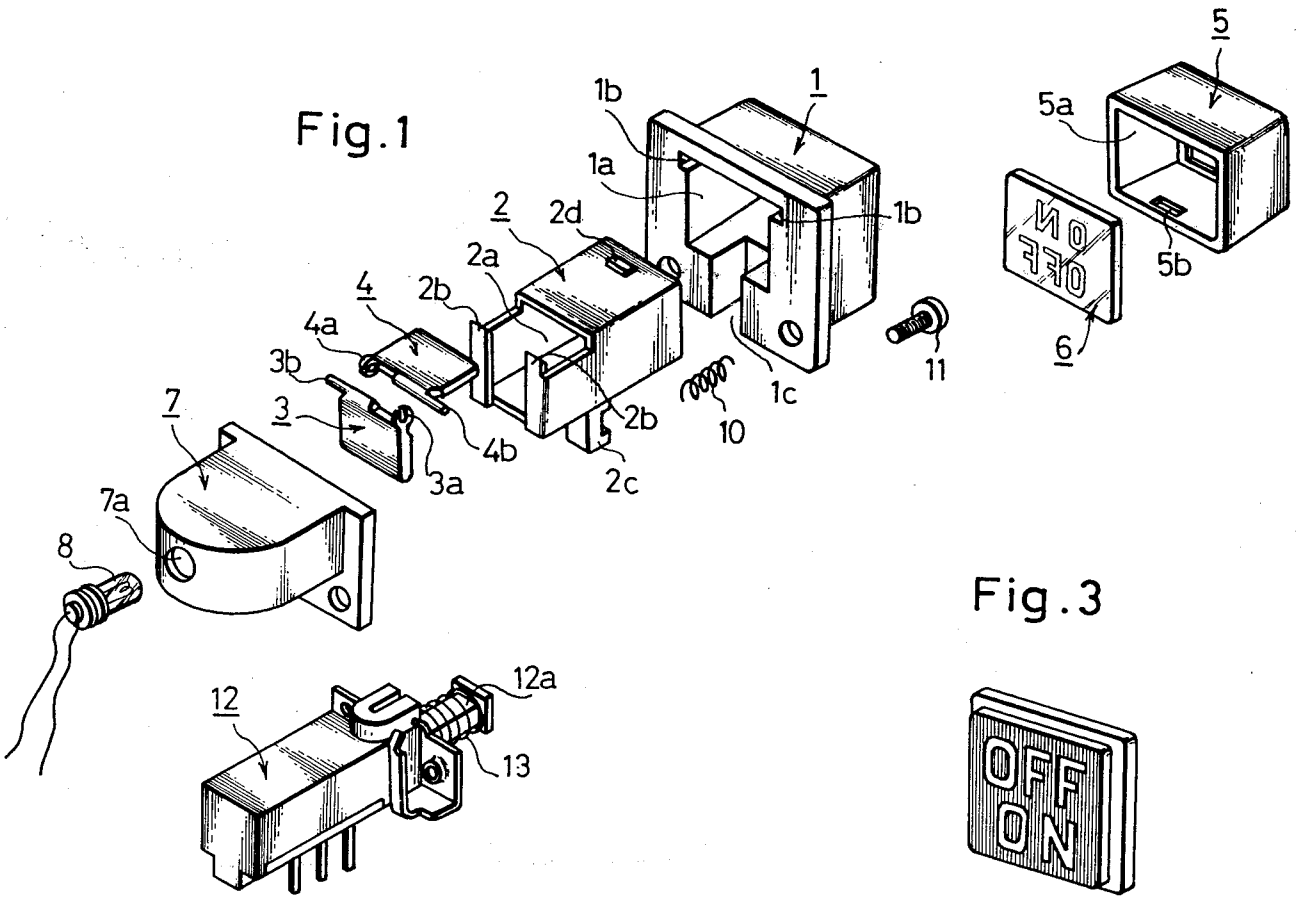
FIG. 1 is an exploded perspective view of an illuminated push-button electrical switch embodying the present invention.
FIG. 3 is a perspective view showing an embodiment of an indicating member.

Referring to FIG. 1, the switch includes a molded synthetic resin casing 1 having a passageway 1*a*, bearing portions 1*b* and 1*b*, and a slot 1*c*. An operating member 2 is molded from a synthetic resin and slidably mounted within the passageway 1*a* of the casing 1. The operating member 2 has a hollow part 2*a*, tongue pieces 2*b* and 2*b*, and an operating arm 2*c*. Two filter members 3 and 4, connected each other perpendicularly by means of connecting portions 3*a* and 4*a*, are pivotably mounted on the bearing portion 1*b* and 1*b* by means of shafts 3*b* and 4*b*. The filter means 3 and 4 are made from transparent material such as acrylic resin, and are provided complementary color, for example, if the filter 3 is colored red or yellow, the filter 4 is colored blue-green or blue respectively. A cap member 5 having a through hole 5*a* to which a indicating plate 6 to be inserted. The cap member 5 with the indicating plate 6 is adapted to be connected with the operating member 2 by means of projections 2*d* and recesses 5*b*. The indicating plate 6 is made from transparent material such as acrylic resin and containing letterings "ON" and "OFF" as shown in FIG. 3. Two letterings are colored comprementary color, for example, "ON" is colored blue-green and "OFF" is colored red, and a remaining area is colored black. A cover member 7 having a hole 7*a* for mounting a lamp 8 is connected to the rear portion of the casing 1 by means of screws 11. A coiled spring 10 is interposed between the operation arm 2*c* of the operating member 2 and the inner wall of the casing 1 at the slot 1*c*. A push-button switch unit 12 is the conventional push-button switch, having a coiled spring 13 and operating rod 12*a* which is operable as an independent switch.

Figure 2A:
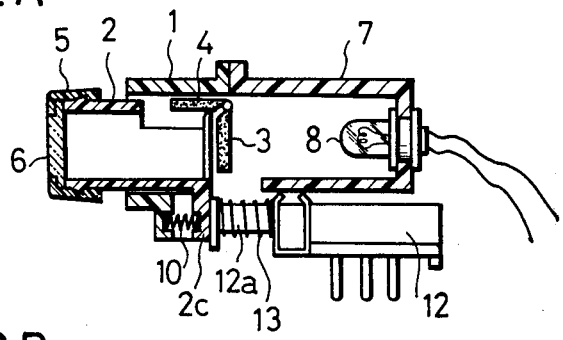
FIGS. 2A, 2B and 2C are sectional side elevations of essential portions for explaining the operation of the embodiment shown in FIG. 1.
Figure 2B:
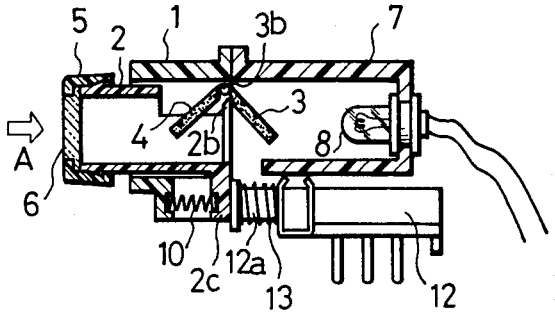
Figure 2C:
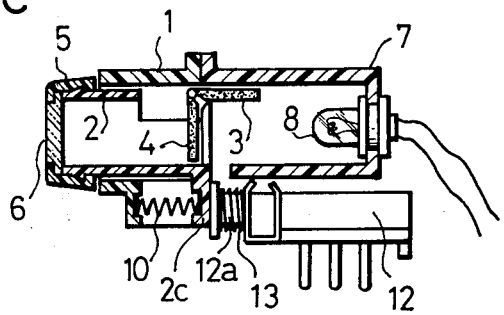

The illuminated push-button switch of the present invention operates as will now be described. FIG. 2A illustrates the state in which the operating member 2 is not depressed. Since the lamp 8 is lit up at all times and the light of the lamp 8 passes through the red colored filter means 3, only the red beam is reached to the indicating plate 6. At the indicating plate 6, the red beam can not pass through the lettering "ON" because it is colored its complementary color of blue-green while the red beam passes through the lettering "OFF" because it is colored red, and thus the letter "OFF" is illuminated in red as seen by the viewer. When the operating member 2 is depressed in this state, the operating rod 12*a* of the switch unit 12 is pressed down to the direction of arrow A against the spring pressure of the coiled spring 13 by the operating arm 2*c* of the operating member 2, and the switch 12 is changed-over. Simultaneously, the filter members 3 and 4 are turned about the pivots 3*b* and 4*b* by the movement of the tongue pieces 2*b* and 2*b* of the operating member 2. As a result, the filter 3 having been located in the path of the light moves out of the path (refer to FIG. 2*c*). In this state, the light of the lamp 8 passes through the blue-green colored filter 4. Therefore, only the lettering "ON" is illuminated in blue-green as seen by the viewer. FIG. 2B illustrates the state in which the switch is veing changed-over as described above.

What is claimed is:

1. An illuminated assembly for indicating the operation status of a push button switch, comprising:

a casing having an operation member mounted slidably therein, said operation member having an arm portion adapted to engage an operation rod of a push-button switch for movement therewith;

an indicating plate mounted to an exterior end portion of said operation member, said indicating plate having two sets of graphic symbols each adapted to transmit light and corresponding to a respective status of said switch, said sets of graphic symbols each being formed of different but complementary colors;

a light source held to said casing for illuminating said indicating plate;

two filter members carried by said casing and being formed respectively of said complementary colors; and means for positioning said filter members selectively within the light path to said indicating plate during operation of said switch, said filter members being mounted generally orthogonally to one another, said positioning means including tongue elements extending upwardly from said operation member and between said filter members.

* * * * *